US008083609B2

(12) United States Patent
Burnett et al.

(10) Patent No.: US 8,083,609 B2
(45) **Date of Patent: *Dec. 27, 2011**

(54) HIGH VOLUME AERODYNAMIC GOLF CLUB HEAD

(75) Inventors: Michael Scott Burnett, McKinney, TX (US); Jeffrey J. Albertsen, Plano, TX (US)

(73) Assignee: Adams Golf IP, LP, Plano, TX (US)

( * ) Notice: Subject to any disclaimer, the term of this patent is extended or adjusted under 35 U.S.C. 154(b) by 194 days.

This patent is subject to a terminal disclaimer.

(21) Appl. No.: 12/367,839

(22) Filed: Feb. 9, 2009

(65) Prior Publication Data

US 2010/0016096 A1 Jan. 21, 2010

Related U.S. Application Data

(60) Provisional application No. 61/080,892, filed on Jul. 15, 2008, provisional application No. 61/101,919, filed on Oct. 1, 2008.

(51) Int. Cl.
*A63B 53/04* (2006.01)

(52) U.S. Cl. ..... 473/327; 473/345

(58) Field of Classification Search ..... 473/345, 473/327

See application file for complete search history.

(56) References Cited

U.S. PATENT DOCUMENTS 2,083,189 A * 6/1937 Crooker ..... 473/327
3,085,804 A 4/1963 Pieper
3,166,320 A 1/1965 Onions
3,893,672 A 7/1975 Schonher
3,985,363 A 10/1976 Jepson et al.
3,997,170 A 12/1976 Goldberg
4,065,133 A 12/1977 Gordos (Continued)

FOREIGN PATENT DOCUMENTS

WO 2005009543 A2 2/2005

OTHER PUBLICATIONS

International Searching Authority (USPTO), International Search Report and Written Opinion for International Application No. PCT/US2009/049418, mailed Aug. 26, 2009, 10 pages.

(Continued)

*Primary Examiner* — Gene Kim
*Assistant Examiner* — Michael Dennis
(74) *Attorney, Agent, or Firm* — David J. Dawsey; Michael J. Gallagher; Gallagher & Dawsey Co., LPA

(57) ABSTRACT

A high volume aerodynamic golf club head with a club head volume of at least 400 cc and a front-to-back dimension of at least 4.4 inches producing a face-on normalized aerodynamic drag force of less than 1.5 lbf when exposed to a 100 mph wind parallel to the ground plane and oriented at the front of the club head. The club head has a crown section having a crown apex located an apex height above a ground plane, wherein a portion of the crown section between the crown apex and the face has an apex-to-front radius of curvature that is less than 3 inches. An apex ratio of the apex height to a maximum face top edge height is at least 1.13. The apex height and location of the crown apex obtain desirable airflow reattachment close to the face and improve airflow attachment to the crown section.

20 Claims, 8 Drawing Sheets

U.S. PATENT DOCUMENTS

| | | | | |
|---|---|---|---|---|
| 4,077,633 | A | 3/1978 | Studen | |
| 4,139,196 | A | 2/1979 | Riley | |
| 4,147,349 | A | 4/1979 | Jeghers | |
| 4,165,076 | A | 8/1979 | Cella | |
| 4,193,601 | A | 3/1980 | Reid, Jr. et al. | |
| D256,709 | S | 9/1980 | Reid, Jr. et al. | |
| 4,247,105 | A | 1/1981 | Jeghers | |
| 4,431,192 | A | 2/1984 | Stuff, Jr. | |
| 4,527,799 | A | 7/1985 | Solheim | |
| 4,592,552 | A | 6/1986 | Garber | |
| 4,754,974 | A | 7/1988 | Kobayashi | |
| 4,787,636 | A | 11/1988 | Honma | |
| 4,881,739 | A | 11/1989 | Garcia | |
| 4,895,367 | A | 1/1990 | Kajita et al. | |
| 4,919,428 | A | 4/1990 | Perkins | |
| 5,092,599 | A | 3/1992 | Okumoto et al. | |
| 5,116,054 | A | 5/1992 | Johnson | |
| 5,190,289 | A | 3/1993 | Nagai et al. | |
| 5,193,810 | A | 3/1993 | Antonious | |
| 5,221,086 | A | 6/1993 | Antonious | |
| 5,255,919 | A | 10/1993 | Johnson | |
| 5,301,944 | A | 4/1994 | Koehler | |
| 5,318,297 | A | 6/1994 | Davis et al. | |
| 5,340,106 | A | 8/1994 | Ravaris | |
| 5,482,280 | A | 1/1996 | Yamawaki | |
| 5,511,786 | A | 4/1996 | Antonious | |
| 5,558,332 | A | 9/1996 | Cook | |
| D375,130 | S | 10/1996 | Hlinka et al. | |
| D378,770 | S | 4/1997 | Hlinka et al. | |
| 5,632,695 | A | 5/1997 | Hlinka et al. | |
| 5,695,412 | A | 12/1997 | Cook | |
| 5,700,208 | A | 12/1997 | Nelms | |
| 5,759,114 | A | 6/1998 | Bluto et al. | |
| 5,785,608 | A | 7/1998 | Collins | |
| 5,876,293 | A | 3/1999 | Musty | |
| 5,885,166 | A | 3/1999 | Shiraishi | |
| 5,890,971 | A | 4/1999 | Shiraishi | |
| 5,935,020 | A * | 8/1999 | Stites et al. | 473/345 |
| 5,954,595 | A | 9/1999 | Antonious | |
| 6,001,029 | A | 12/1999 | Kobayashi | |
| 6,033,319 | A | 3/2000 | Farrar | |
| 6,074,308 | A | 6/2000 | Domas | |
| 6,083,115 | A | 7/2000 | King | |
| 6,093,113 | A | 7/2000 | Mertens | |
| 6,123,627 | A | 9/2000 | Antonious | |
| 6,168,537 | B1 | 1/2001 | Ezawa | |
| 6,458,042 | B1 | 10/2002 | Chen | |
| 6,464,598 | B1 | 10/2002 | Miller | |
| 6,530,847 | B1 | 3/2003 | Antonious | |
| 6,723,002 | B1 | 4/2004 | Barlow | |
| 6,773,359 | B1 | 8/2004 | Lee | |
| 6,855,068 | B2 | 2/2005 | Antonious | |
| 7,004,849 | B2 | 2/2006 | Cameron | |
| 7,163,470 | B2 * | 1/2007 | Galloway et al. | 473/342 |
| 7,169,058 | B1 | 1/2007 | Fagan | |
| D543,600 | S | 5/2007 | Oldknow | |
| D544,939 | S | 6/2007 | Radcliffe et al. | |
| D554,720 | S | 11/2007 | Barez et al. | |
| 7,294,064 | B2 | 11/2007 | Tsurumaki et al. | |
| 7,390,266 | B2 | 6/2008 | Gwon | |
| 2002/0183130 | A1 | 12/2002 | Pacinella | |
| 2003/0220154 | A1 | 11/2003 | Anelli | |
| 2004/0192463 | A1 | 9/2004 | Tsurumaki et al. | |
| 2006/0009305 | A1 | 1/2006 | Lindsay | |
| 2006/0094535 | A1 | 5/2006 | Cameron | |
| 2006/0281581 | A1 | 12/2006 | Yamamoto | |
| 2007/0105657 | A1 | 5/2007 | Hirano | |
| 2007/0275792 | A1 | 11/2007 | Horacek et al. | |

OTHER PUBLICATIONS

Excerpts from Golf Digest; magazine; Feb. 2004; Article entitled: "The Hot List", cover page from magazine and article on pp. 82-88.

Excerpts from Golf Digest; magazine; Feb. 2005; Article entitled: "The Hot List", cover page from magazine and article on pp. 119-130. (Part 1).

Excerpts from Golf Digest; magazine; Feb. 2005; Article entitled: "The Hot List", article on pp. 131-143. (Part 2).

Excerpts from Golf Digest; magazine; Feb. 2006; Article entitled: "The Hot List", cover page from magazine and article on pp. 122-132. (Part 1).

Excerpts from Golf Digest; magazine; Feb. 2006; Article entitled: "The Hot List", article on pp. 133-143. (Part 2).

Excerpts from Golf Digest; magazine; Feb. 2007; Article entitled: "The Hot List", cover page from magazine and article on pp. 130-151.

Excerpts from Golf Digest; magazine; Feb. 2008; Article entitled: "The Hot List", cover page from magazine and article on pp. 114-139.

Excerpts from Golf Digest; magazine; Feb. 2009; Article entitled: "The Hot List", cover page from magazine and article on pp. 101-127.

International Searching Authority (USPTO), International Search Report and Written Opinion for International Application No. PCT/US 09/49742, mailed Aug. 27, 2009, 11 pages.

* cited by examiner

HIGH VOLUME AERODYNAMIC GOLF CLUB HEAD

CROSS-REFERENCE TO RELATED APPLICATIONS

This application claims the benefit of U.S. provisional patent application Ser. No. 61/080,892, filed on Jul. 15, 2008, and U.S. provisional patent application Ser. No. 61/101,919, filed on Oct. 1, 2008, all of which are incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to sports equipment; particularly, to a high volume aerodynamic golf club head.

BACKGROUND OF THE INVENTION

Modern high volume golf club heads, namely drivers, are being designed with little, if any, attention paid to the aerodynamics of the golf club head. This stems in large part from the fact that in the past the aerodynamics of golf club heads were studied and it was found that the aerodynamics of the club head had only minimal impact on the performance of the golf club.

The drivers of today have club head volumes that are often double the volume of the most advanced club heads from just a decade ago. In fact, virtually all modern drivers have club head volumes of at least 400 cc, with a majority having volumes right at the present USGA mandated limit of 460 cc. Still, golf club designers pay little attention to the aerodynamics of these large golf clubs; often instead focusing solely on increasing the club head's resistance to twisting during off-center shots.

The modern race to design golf club heads that greatly resist twisting, meaning that the club heads have large moments of inertia, has led to club heads having very long front-to-back dimensions. The front-to-back dimension of a golf club head, often annotated the FB dimension, is measured from the leading edge of the club face to the furthest back portion of the club head. Currently, in addition to the USGA limit on the club head volume, the USGA limits the front-to-back dimension (FB) to 5 inches and the moment of inertia about a vertical axis passing through the club head's center of gravity (CG), referred to as MOIy, to 5900 g*cm$^2$. One of skill in the art will know the meaning of "center of gravity," referred to herein as CG, from an entry level course on mechanics. With respect to wood-type golf clubs, which are generally hollow and/or having non-uniform density, the CG is often thought of as the intersection of all the balance points of the club head. In other words, if you balance the head on the face and then on the sole, the intersection of the two imaginary lines passing straight through the balance points would define the point referred to as the CG.

Until just recently the majority of drivers had what is commonly referred to as a "traditional shape" and a 460 cc club head volume. These large volume traditional shape drivers had front-to-back dimensions (FB) of approximately 4.0 inches to 4.3 inches, generally achieving an MOIy in the range of 4000-4600 g*cm$^2$. As golf club designers strove to increase MOIy as much as possible, the FB dimension of drivers started entering the range of 4.3 inches to 5.0 inches. The graph of FIG. 1 shows the FB dimension and MOIy of 83 different club head designs and nicely illustrates that high MOIy values come with large FB dimensions.

While increasing the FB dimension to achieve higher MOIy values is logical, significant adverse effects have been observed in these large FB dimension clubs. One significant adverse effect is a dramatic reduction in club head speed, which appears to have gone unnoticed by many in the industry. The graph of FIG. 2 illustrates player test data with drivers having an FB dimension greater than 3.6 inches. The graph illustrates considerably lower club head speeds for large FB dimension drivers when compared to the club head speeds of drivers having FB dimensions less than 4.4 inches. In fact, a club head speed of 104.6 mph was achieved when swinging a driver having a FB dimension of less than 3.8 inches, while the swing speed dropped over 3% to 101.5 mph when swinging a driver with a FB dimension of slightly less than 4.8 inches.

This significant decrease in club head speed is the result of the increase in aerodynamic drag forces associated with large FB dimension golf club heads. Data obtained during extensive wind tunnel testing shows a strong correlation between club head FB dimension and the aerodynamic drag measured at several critical orientations. First, orientation one is identified in FIG. 11 with a flow arrow labeled as "Air Flow—90°" and is referred to in the graphs of the figures as "lie 90 degree orientation." This orientation can be thought of as the club head resting on the ground plane (GP) with the shaft axis (SA) at the club head's design lie angle, as seen in FIG. 8. Then a 100 mph wind is directed parallel to the ground plane (GP) directly at the club face (200), as illustrated by the flow arrow labeled "Air Flow—90°" in FIG. 11.

Secondly, orientation two is identified in FIG. 11 with a flow arrow labeled as "Air Flow—60°" and is referred to in the graphs of the figures as "lie 60 degree orientation." This orientation can be thought of as the club head resting on the ground plane (GP) with the shaft axis (SA) at the club head's design lie angle, as seen in FIG. 8. Then a 100 mph wind is wind is oriented thirty degrees from a vertical plane normal to the face (200) with the wind originating from the heel (116) side of the club head, as illustrated by the flow arrow labeled "Air Flow—60°" in FIG. 11.

Thirdly, orientation three is identified in FIG. 12 with a flow arrow labeled as "Air Flow—Vert.—0°" and is referred to in the graphs of the figures as "vertical 0 degree orientation." This orientation can be thought of as the club head being oriented upside down with the shaft axis (SA) vertical while being exposed to a horizontal 100 mph wind directed at the heel (116), as illustrated by the flow arrow labeled "Air Flow—Vert.—0°" in FIG. 12. Thus, the air flow is parallel to the vertical plane created by the shaft axis (SA) seen in FIG. 11, blowing from the heel (116) to the toe (118) but with the club head oriented as seen in FIG. 12.

Now referring back to orientation one, namely the orientation identified in FIG. 11 with a flow arrow labeled as "Air Flow—90°." Normalized aerodynamic drag data has been gathered for six different club heads and is illustrated in the graph of FIG. 5. At this point it is important to understand that all of the aerodynamic drag forces mentioned herein, unless otherwise stated, are aerodynamic drag forces normalized to a 120 mph airstream velocity. Thus, the illustrated aerodynamic drag force values are the actual measured drag force at the indicated airstream velocity multiplied by the square of the reference velocity, which is 120 mph, then divided by the square of the actual airstream velocity. Therefore, the normalized aerodynamic drag force plotted in FIG. 5 is the actual measured drag force when subjected to a 100 mph wind at the specified orientation, multiplied by the square of the 120 mph reference velocity, and then divided by the square of the 100 mph actual airstream velocity.

Still referencing FIG. 5, the normalized aerodynamic drag force increases non-linearly from a low of 1.2 lbf with a short 3.8 inch FB dimension club head to a high of 2.65 lbf for a club head having a FB dimension of almost 4.8 inches. The increase in normalized aerodynamic drag force is in excess of 120% as the FB dimension increases slightly less than one inch, contributing to the significant decrease in club head speed previously discussed.

The results are much the same in orientation two, namely the orientation identified in FIG. 11 with a flow arrow labeled as "Air Flow—60°." Again, normalized aerodynamic drag data has been gathered for six different club heads and is illustrated in the graph of FIG. 4. The normalized aerodynamic drag force increases non-linearly from a low of approximately 1.1 lbf with a short 3.8 inch FB dimension club head to a high of approximately 1.9 lbf for a club head having a FB dimension of almost 4.8 inches. The increase in normalized aerodynamic drag force is almost 73% as the FB dimension increases slightly less than one inch, also contributing to the significant decrease in club head speed previously discussed.

Again, the results are much the same in orientation three, namely the orientation identified in FIG. 12 with a flow arrow labeled as "Air Flow—Vert.—0°." Again, normalized aerodynamic drag data has been gathered for several different club heads and is illustrated in the graph of FIG. 3. The normalized aerodynamic drag force increases non-linearly from a low of approximately 1.15 lbf with a short 3.8 inch FB dimension club head to a high of approximately 2.05 lbf for a club head having a FB dimension of almost 4.8 inches. The increase in normalized aerodynamic drag force is in excess of 78% as the FB dimension increases slightly less than one inch, also contributing to the significant decrease in club head speed previously discussed.

Further, the graph of FIG. 6 correlates the player test club head speed data of FIG. 2 with the maximum normalized aerodynamic drag force for each club head from FIG. 3, 4, or 5. Thus, FIG. 6 shows that the club head speed drops from 104.6 mph, when the maximum normalized aerodynamic drag force is only 1.2 lbf, down to 101.5 mph, when the maximum normalized aerodynamic drag force is 2.65 lbf.

The drop in club head speed just described has a significant impact on the speed at which the golf ball leaves the club face after impact and thus the distance that the golf ball travels. In fact, for a club head speed of approximately 100 mph, each 1 mph reduction in club head speed results in approximately a 1% loss in distance. The present golf club head has identified these relationships, the reason for the drop in club head speed associated with long FB dimension clubs, and several ways to reduce the aerodynamic drag force of golf club heads.

SUMMARY OF THE INVENTION

The claimed aerodynamic golf club head has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. Several problems are the significantly flat surfaces on the body, the lack of proper shaping to account for airflow reattachment in the crown area trailing the face, and the lack of proper trailing edge design. In addition, current large FB dimension driver designs have ignored, or even tried to maximize in some cases, the frontal cross sectional area of the golf club head which increases the aerodynamic drag force.

The present aerodynamic golf club head solves these issues and results in a high volume aerodynamic golf club head having a relatively large FB dimension with beneficial moment of inertia values, while also obtaining superior aerodynamic properties unseen by other large volume, large FB dimension, high MOI golf club heads. The golf club head obtains superior aerodynamic performance through the use of unique club head shapes defined by numerous variables including, but not limited to, a crown apex located an apex height above a ground plane, and three distinct radii that improve the aerodynamic performance.

The club head has a crown section having a portion between the crown apex and a front of the club head with an apex-to-front radius of curvature that is less than 3 inches. Likewise, a portion of the crown section between the crown apex and a back of the club head has an apex-to-rear radius of curvature that is less than 3.75 inches. Lastly, a portion of the crown section has a heel-to-toe radius of curvature at the crown apex in a direction parallel to a vertical plane created by a shaft axis that is less than 4 inches. Such small radii of curvature herein have traditionally been avoided in the design of high volume golf club heads, especially in the design of high volume golf club heads having FB dimensions of 4.4 inches and greater. However, these tight radii produce a bulbous crown section that facilitates airflow reattachment as close to a club head face as possible, thereby resulting in reduced aerodynamic drag forces and producing higher club head speeds.

BRIEF DESCRIPTION OF THE DRAWINGS

Without limiting the scope of the present aerodynamic golf club head as claimed below and referring now to the drawings and figures:

Figure 1:
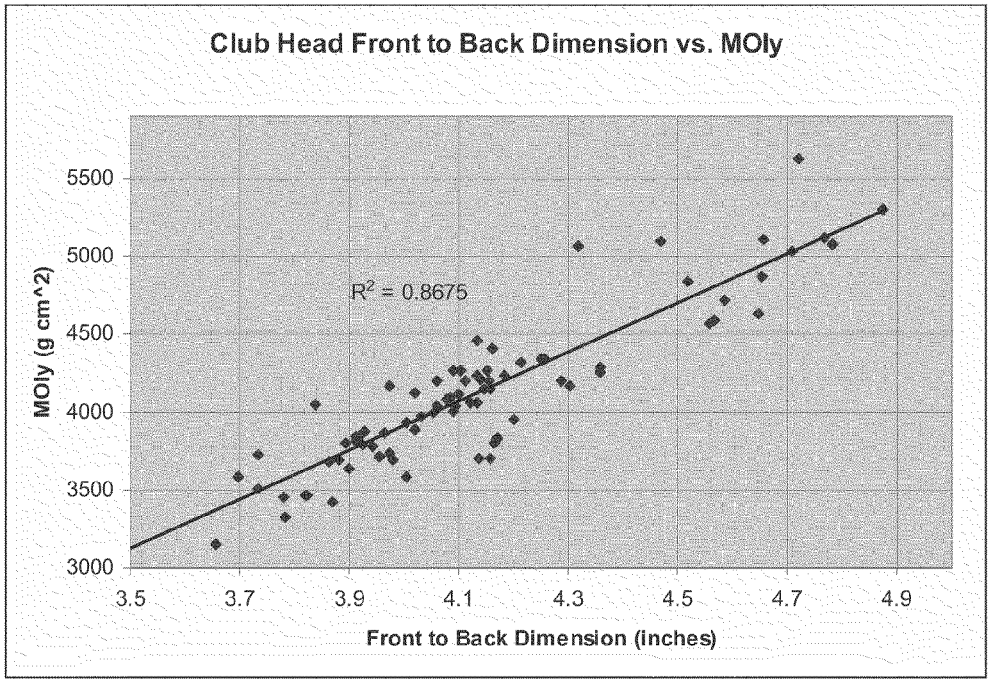
FIG. 1 shows a graph of FB dimensions versus MOIy.
Figure 2:
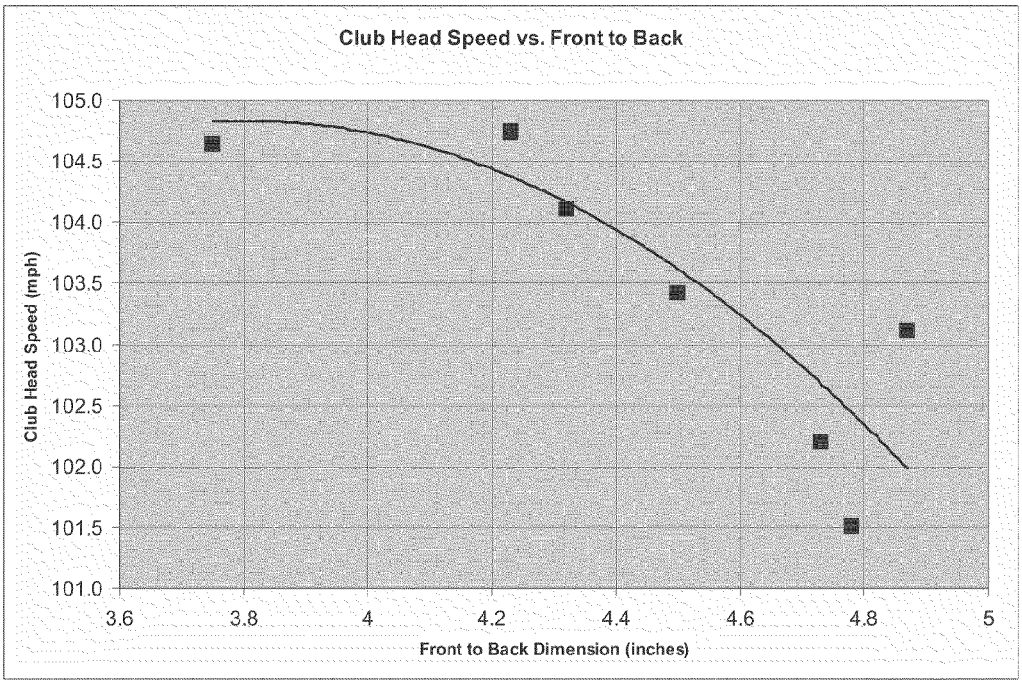
FIG. 2 shows a graph of FB dimensions versus club head speed.
Figure 3:
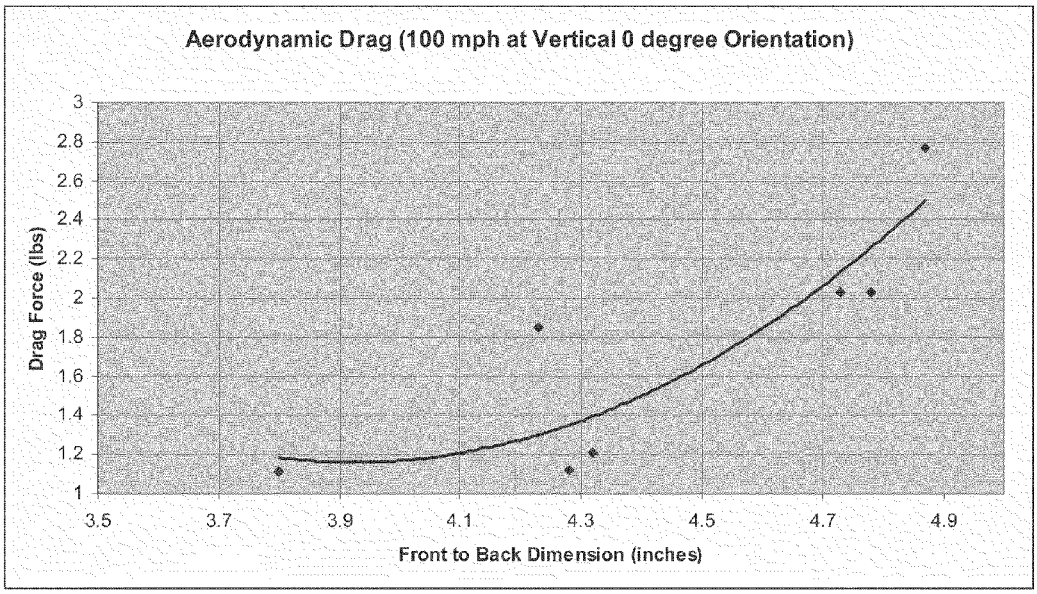
FIG. 3 shows a graph of FB dimensions versus club head normalized aerodynamic drag force.
Figure 4:
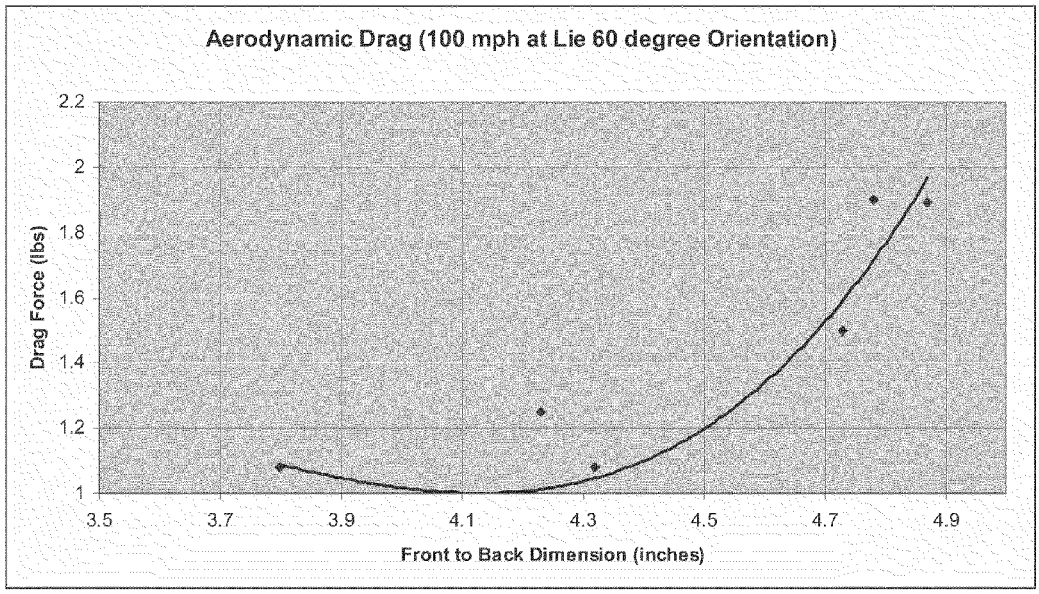
FIG. 4 shows a graph of FB dimensions versus club head normalized aerodynamic drag force.
Figure 5:
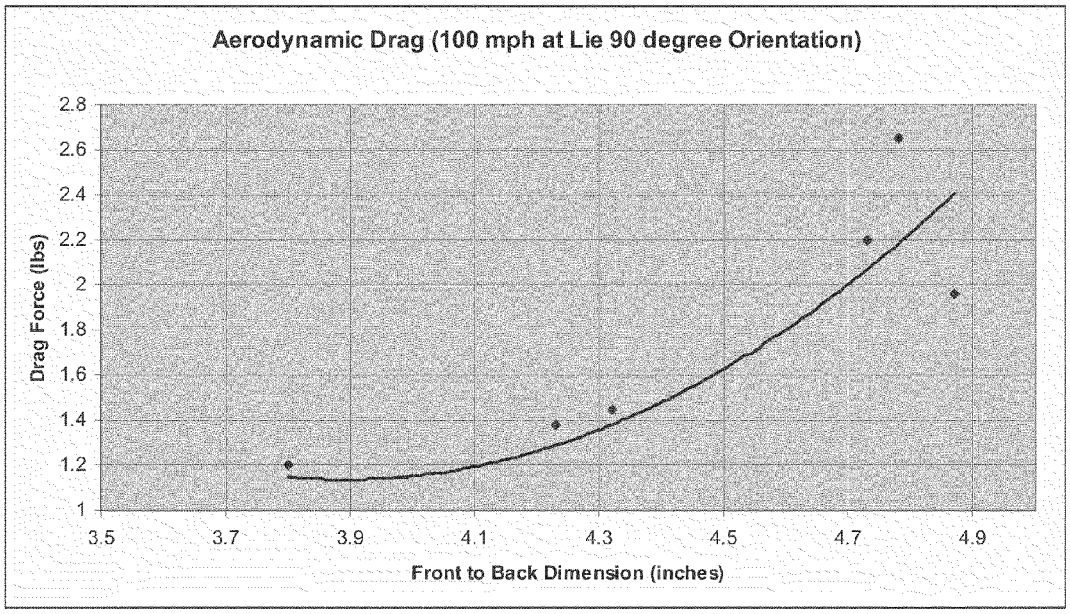
FIG. 5 shows a graph of FB dimensions versus club head normalized aerodynamic drag force.
Figure 6:
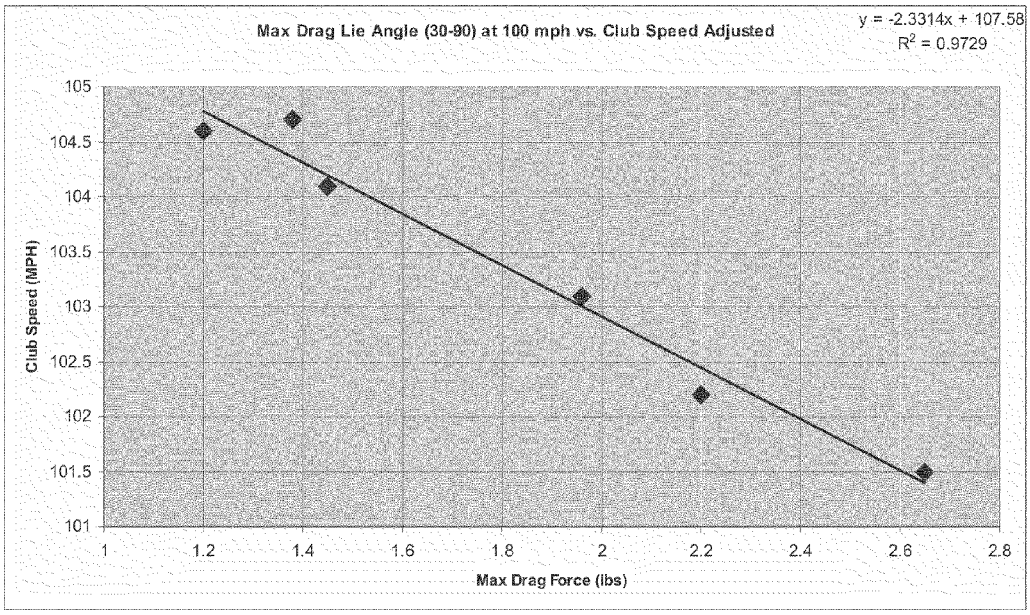
FIG. 6 shows a graph of club head normalized aerodynamic drag force versus club head speed.

These drawings are provided to assist in the understanding of the exemplary embodiments of the high volume aerodynamic golf club head as described in more detail below and should not be construed as unduly limiting the present golf club head. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The claimed high volume aerodynamic golf club head (100) enables a significant advance in the state of the art. The preferred embodiments of the club head (100) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the club head (100), and is not intended to represent the only form in which the club head (100) may be constructed or utilized. The description sets forth the designs, functions, means, and methods of implementing the club head (100) in connection with the illustrated embodiments. It is to be understood, however, that the same or equivalent functions and features may be accomplished by different embodiments that are also intended to be encompassed within the spirit and scope of the club head (100).

The present high volume aerodynamic golf club head (100) has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. The main problems are the significantly flat surfaces on the body, the lack of proper shaping to account for airflow reattachment in the crown area trailing the face, and the lack of proper trailing edge design. In addition, current large FB dimension driver designs have ignored, or even tried to maximize in some cases, the frontal cross sectional area of the golf club head which increases the aerodynamic drag force. The present aerodynamic golf club head (100) solves these issues and results in a high volume aerodynamic golf club head (100) having a large FB dimension and a high MOIy.

The present high volume aerodynamic golf club head (100) has a volume of at least 400 cc. It is characterized by a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100), as previously described with respect to FIG. 11 and the flow arrow labeled "air flow—90°." As explained in the "Background" section, but worthy of repeating in this section, all of the aerodynamic drag forces mentioned herein, unless otherwise stated, are aerodynamic drag forces normalized to a 120 mph airstream velocity. Thus, the above mentioned normalized aerodynamic drag force of less than 1.5 lbf when exposed to a 100 mph wind is the actual measured drag force at the indicated 100 mph airstream velocity multiplied by the square of the reference velocity, which is 120 mph, then divided by the square of the actual airstream velocity, which is 100 mph.

Figure 7:
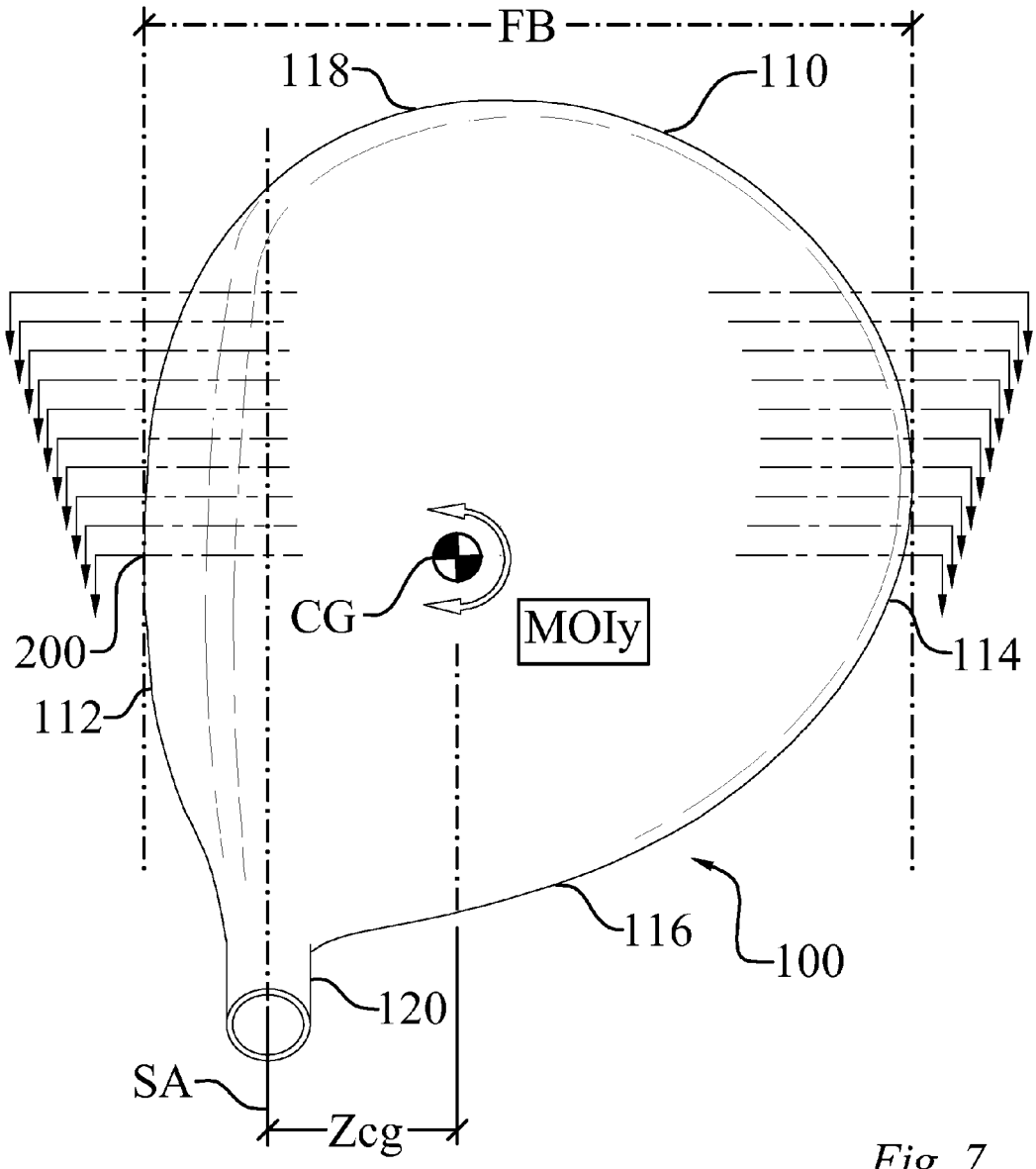
FIG. 7 shows a top plan view of a high volume aerodynamic golf club head, not to scale.
Figure 8:
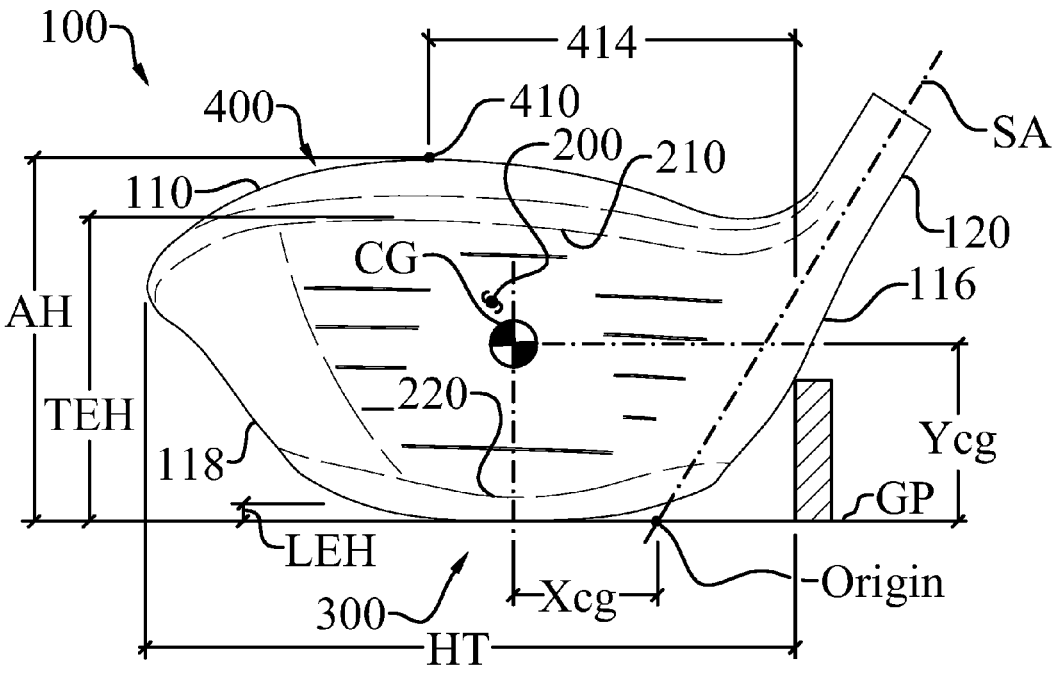
FIG. 8 shows a front elevation view of a high volume aerodynamic golf club head, not to scale.
Figure 9:
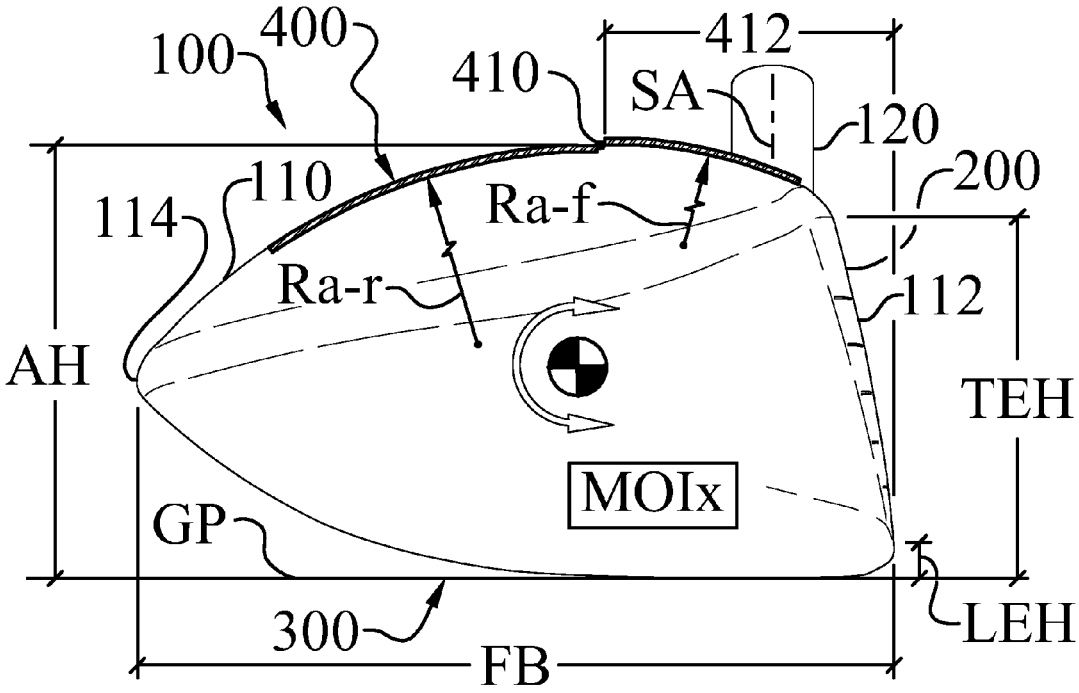
FIG. 9 shows a toe side elevation view of a high volume aerodynamic golf club head, not to scale.

With general reference to FIGS. 7-9, the high volume aerodynamic golf club head (100) includes a hollow body (110) having a face (200), a sole section (300), and a crown section (400). The hollow body (110) may be further defined as having a front (112), a back (114), a heel (116), and a toe (118). Further, the hollow body (110) has a front-to-back dimension (FB) of at least 4.4 inches, as previously defined and illustrated in FIG. 7.

The relatively large FB dimension of the present high volume aerodynamic golf club head (100) aids in obtaining beneficial moment of inertia values while also obtaining superior aerodynamic properties unseen by other large volume, large FB dimension, high MOI golf club heads. Specifically, an embodiment of the high volume aerodynamic golf club head (100) obtains a first moment of inertia (MOIy) about a vertical axis through a center of gravity (CG) of the golf club head (100), illustrated in FIG. 7, that is at least 4000 $g*cm^2$. MOIy is the moment of inertia of the golf club head (100) that resists opening and closing moments induced by ball strikes towards the toe side or heel side of the face. Further, this embodiment obtains a second moment of inertia (MOIx) about a horizontal axis through the center of gravity (CG), as seen in FIG. 9, that is at least 2000 $g*cm^2$. MOIx is the moment of inertia of the golf club head (100) that resists lofting and delofting moments induced by ball strikes high or low on the face (200).

Figure 10:
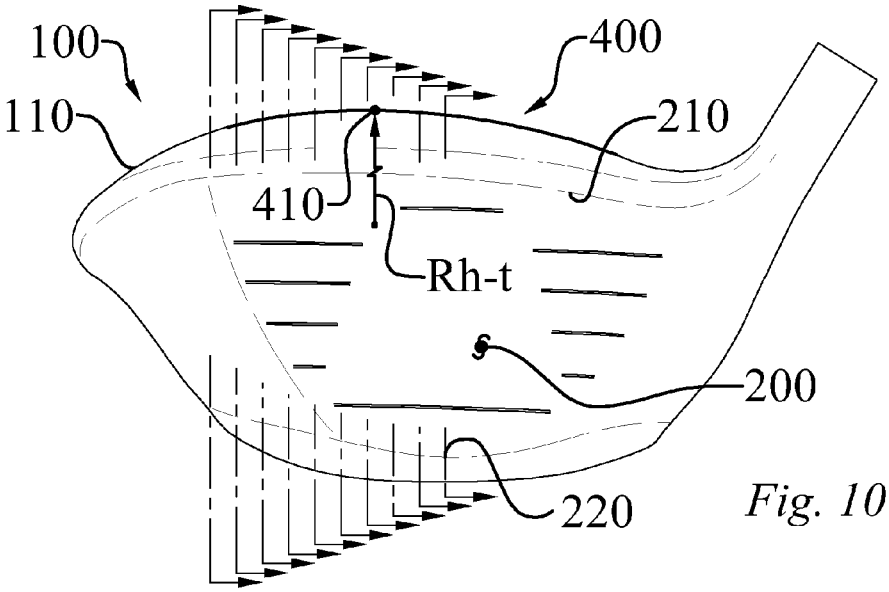
FIG. 10 shows a front elevation view of a high volume aerodynamic golf club head, not to scale.

The golf club head (100) obtains superior aerodynamic performance through the use of unique club head shapes. Referring now to FIG. 8, the crown section (400) has a crown apex (410) located an apex height (AH) above a ground plane (GP). The apex height (AH), as well as the location of the crown apex (410), play important roles in obtaining desirable airflow reattachment as close to the face (200) as possible, as well as improving the airflow attachment to the crown section (400). With reference now to FIGS. 9 and 10, the crown section (400) has three distinct radii that improve the aerodynamic performance of the present club head (100). First, as seen in FIG. 9, a portion of the crown section (400) between the crown apex (410) and the front (112) has an apex-to-front radius of curvature (Ra-f) that is less than 3 inches. The apex-to-front radius of curvature (Ra-f) is measured in a vertical plane that is perpendicular to a vertical plane passing through the shaft axis (SA), and the apex-to-front radius of curvature (Ra-f) is further measured at the point on the crown section (400) between the crown apex (410) and the front (112) that has the smallest the radius of curvature. In one particular embodiment, at least fifty percent of the vertical plane cross sections taken perpendicular to a vertical plane passing through the shaft axis (SA), which intersect a portion of a face top edge (210), are characterized by an apex-to-front radius of curvature (Ra-f) of less than 3 inches. In still a further embodiment, at least ninety percent of the vertical plane cross sections taken perpendicular to a vertical plane passing through the shaft axis (SA), which intersect a portion of the face top edge (210), are characterized by an apex-to-front radius of curvature (Ra-f) of less than 3 inches. In yet another embodiment, at least fifty percent of the vertical plane cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches. Still further, another embodiment has at least fifty percent of the vertical plane cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches.

The center of the face (200) shall be determined in accordance with the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center.

Secondly, a portion of the crown section (400) between the crown apex (410) and the back (114) of the hollow body (110) has an apex-to-rear radius of curvature (Ra-r) that is less than 3.75 inches. The apex-to-rear radius of curvature (Ra-r) is also measured in a vertical plane that is perpendicular to a vertical plane passing through the shaft axis (SA), and the apex-to-rear radius of curvature (Ra-r) is further measured at the point on the crown section (400) between the crown apex (410) and the back (114) that has the smallest the radius of curvature. In one particular embodiment, at least fifty percent of the vertical plane cross sections taken perpendicular to a vertical plane passing through the shaft axis (SA), which intersect a portion of the face top edge (210), are characterized by an apex-to-rear radius of curvature (Ra-r) of less than 3.75 inches. In still a further embodiment, at least ninety percent of the vertical plane cross sections taken perpendicular to a vertical plane passing through the shaft axis (SA), which intersect a portion of the face top edge (210), are characterized by an apex-to-rear radius of curvature (Ra-r) of less than 3.75 inches. In yet another embodiment, one hundred percent of the vertical plane cross sections taken perpendicular to a vertical plane passing through the shaft axis (SA), which intersect a portion of the face top edge (210) between the center of the face (200) and the toeward most point on the face (200), are characterized by an apex-to-rear radius of curvature (Ra-r) of less than 3.75 inches.

Lastly, as seen in FIG. 10, a portion of the crown section (400) has a heel-to-toe radius of curvature (Rh-t) at the crown apex (410) in a direction parallel to the vertical plane created by the shaft axis (SA) that is less than 4 inches. In a further embodiment, at least ninety percent of the crown section (400) located between the most heelward point on the face (200) and the most toeward point on the face (200) has a heel-to-toe radius of curvature (Rh-t) at the crown apex (410) in a direction parallel to the vertical plane created by the shaft axis (SA) that is less than 4 inches. A further embodiment has one hundred percent of the crown section (400) located between the most heelward point on the face (200) and the most toeward point on the face (200) exhibiting a heel-to-toe radius of curvature (Rh-t), at the crown apex (410) in a direction parallel to the vertical plane created by the shaft axis (SA), that is less than 4 inches.

Such small radii of curvature exhibited in the embodiments described herein have traditionally been avoided in the design of high volume golf club heads, especially in the design of high volume golf club heads having FB dimensions of 4.4 inches and greater. However, it is these tight radii produce a bulbous crown section (400) that facilitates airflow reattachment as close to the face (200) as possible, thereby resulting in reduced aerodynamic drag forces and facilitating higher club head speeds.

Conventional high volume large MOIy golf club heads having large FB dimensions, such as those seen in U.S. Pat. No.544,939 and U.S. Pat. No.543,600, have relatively flat crown sections that often never extend above the face. While these designs appear as though they should cut through the air, the opposite is often true with such shapes achieving poor airflow reattachment characteristics and increased aerodynamic drag forces. The present club head (100) has recognized the significance of proper club head shaping to account for rapid airflow reattachment in the crown section (400) trailing the face (200), which is quite the opposite of the flat steeply sloped crown sections of many prior art large FB dimension club heads.

With reference now to FIG. 10, the face (200) has a top edge (210) and a lower edge (220). Further, as seen in FIGS. 8 and 9, the top edge (210) has a top edge height (TEH) that is the elevation of the top edge (210) above the ground plane (GP). Similarly, the lower edge (220) has a lower edge height (LEH) that is the elevation of the lower edge (220) above the ground plane (GP). The highest point along the top edge (210) produces a maximum top edge height (TEH) that is at least 2 inches. Similarly, the lowest point along the lower edge (220) is a minimum lower edge height (LEH).

One of many significant advances of this embodiment of the present club head (100) is the design of an apex ratio that encourages airflow reattachment on the crown section (400) of the golf club head (100) as close to the face (200) as possible. In other words, the sooner that airflow reattachment is achieved, the better the aerodynamic performance and the smaller the aerodynamic drag force. The apex ratio is the ratio of apex height (AH) to the maximum top edge height (TEH). As previously explained, in many large FB dimension golf club heads the apex height (AH) is no more than the top edge height (TEH). In this embodiment, the apex ratio is at least 1.13, thereby encouraging airflow reattachment as soon as possible.

Figure 13:
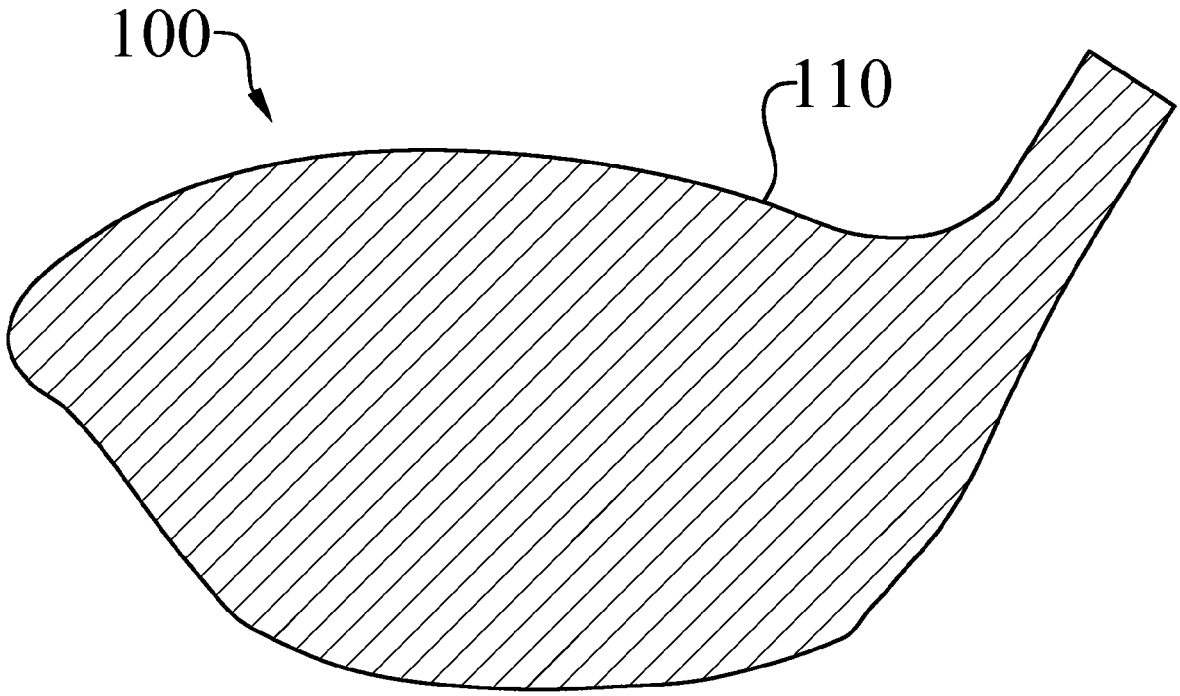
FIG. 13 shows a front elevation view of a high volume aerodynamic golf club head, not to scale.

Still further, this embodiment of the club head (100) has a frontal cross sectional area that is less than 11 square inches. The frontal cross sectional area is the single plane area measured in a vertical plane bounded by the outline of the golf club head (100) when it is resting on the ground plane (GP) at the design lie angle and viewed from directly in front of the face (200). The frontal cross sectional area is illustrated by the cross-hatched area of FIG. 13.

Figure 11:
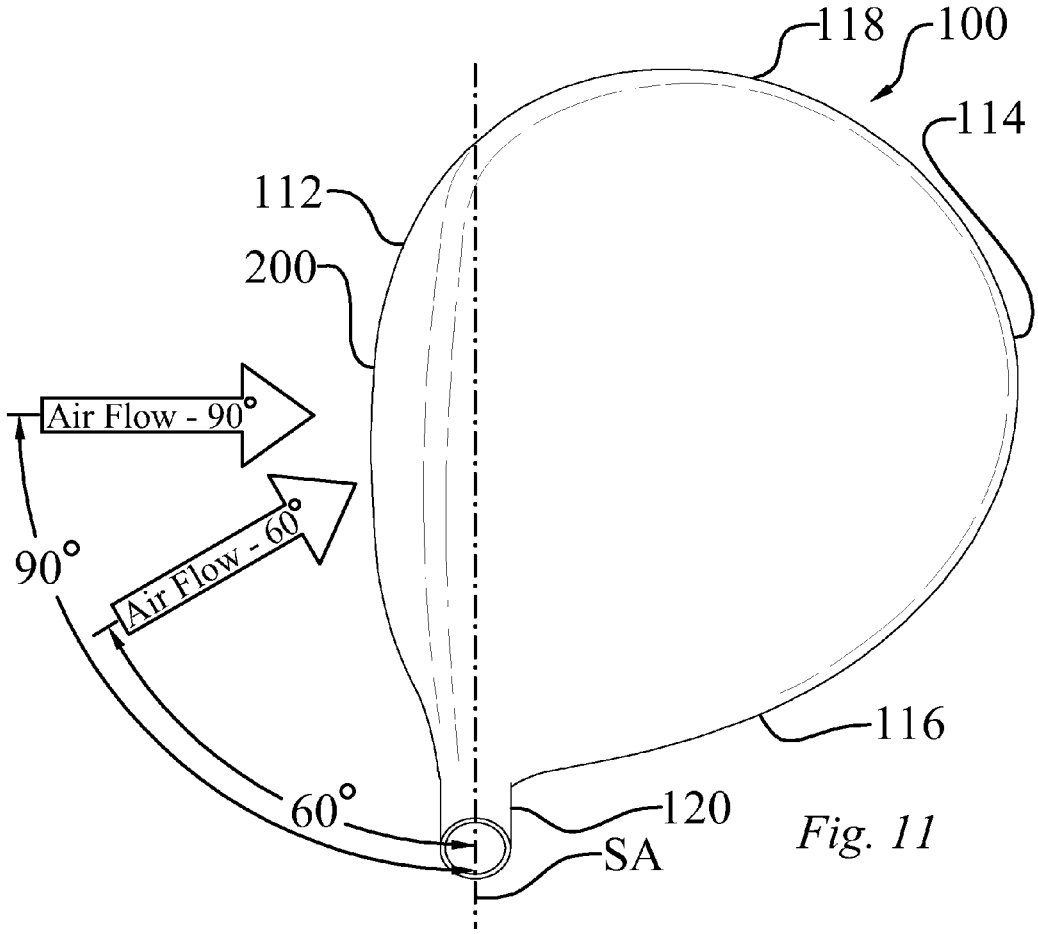
FIG. 11 shows a top plan view of a high volume aerodynamic golf club head, not to scale.

In a further embodiment, a second aerodynamic drag force is introduced, namely the 30 degree offset aerodynamic drag force, as previously explained with reference to FIG. 11. In this embodiment the 30 degree offset normalized aerodynamic drag force is less than 1.3 lbf when exposed to a 100 mph wind parallel to the ground plane (GP) when the high volume aerodynamic golf club head (100) is positioned in a design orientation and the wind is oriented thirty degrees from a vertical plane normal to the face (200) with the wind originating from the heel (116) side of the high volume aerodynamic golf club head (100). In addition to having the face-on normalized aerodynamic drag force less than 1.5 lbf, introducing a 30 degree offset normalized aerodynamic drag force of less than 1.3 lbf further reduces the drop in club head speed associated with large volume, large FB dimension golf club heads.

Figure 12:
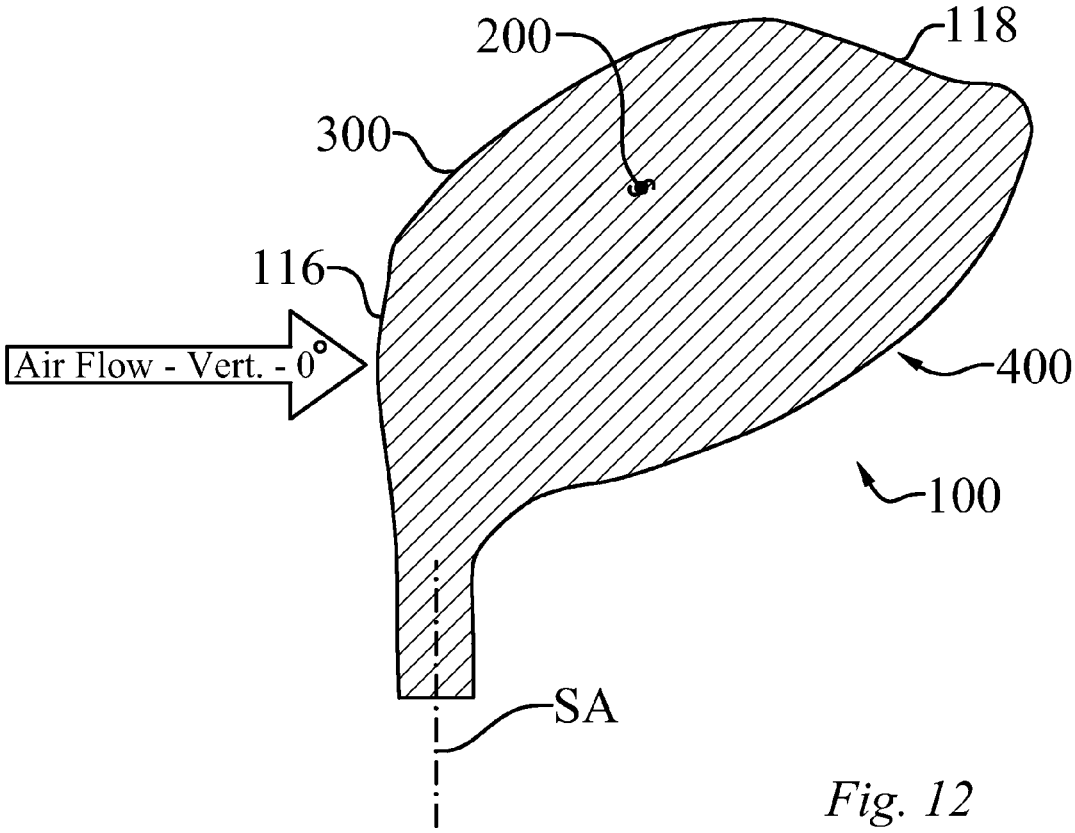
FIG. 12 shows a rotated front elevation view of a high volume aerodynamic golf club head with a vertical shaft axis orientation, not to scale.

Yet another embodiment introduces a third aerodynamic drag force, namely the heel normalized aerodynamic drag force, as previously explained with reference to FIG. 12. In this particular embodiment, the heel normalized aerodynamic drag force is less than 1.9 lbf when exposed to a horizontal 100 mph wind directed at the heel (116) with the body (110) oriented to have a vertical shaft axis (SA). In addition to having the face-on normalized aerodynamic drag force of less than 1.5 lbf and the 30 degree offset normalized aerodynamic drag force of less than 1.3 lbf, having a heel normalized aerodynamic drag force of less than 1.9 lbf further reduces the drop in club head speed associated with large volume, large FB dimension golf club heads.

A still further embodiment has recognized that having the apex-to-front radius of curvature (Ra-f) at least 25% less than the apex-to-rear radius of curvature (Ra-r) produces a particularly aerodynamic golf club head (100) further assisting in airflow reattachment and preferred airflow attachment over the crown section (400). Yet another embodiment further encourages quick airflow reattachment by incorporating an apex ratio of the apex height (AH) to the maximum top edge height (TEH) that is at least 1.2. This concept is taken even further in yet another embodiment in which the apex ratio of the apex height (AH) to the maximum top edge height (TEH) is at least 1.25. Again, these large apex ratios produce a bulbous crown section (400) that facilitates airflow reattachment as close to the face (200) as possible, thereby resulting in reduced aerodynamic drag forces and resulting in higher club head speeds.

Reducing aerodynamic drag by encouraging airflow reattachment, or conversely discouraging extended lengths of airflow separation, may be further obtained in yet another embodiment in which the apex-to-front radius of curvature (Ra-f) is less than the apex-to-rear radius of curvature (Ra-r), and the apex-to-rear radius of curvature (Ra-r) is less than the heel-to-toe radius of curvature (Rh-t). Such a shape is contrary to conventional high volume, long FB dimension golf club heads, yet produces a particularly aerodynamic shape.

Taking this embodiment a step further in another embodiment, a high volume aerodynamic golf club head (100) having the apex-to-front radius of curvature (Ra-f) less than 2.85 inches and the heel-to-toe radius of curvature (Rh-t) less than 3.85 inches produces a reduced face-on aerodynamic drag force. Another embodiment focuses on the playability of the high volume aerodynamic golf club head (100) by having a maximum top edge height (TEH) that is at least 2 inches, thereby ensuring that the face area is not reduced to an unforgiving level. Even further, another embodiment incorporates a maximum top edge height (TEH) that is at least 2.15 inches, further instilling confidence in the golfer that they are not swinging a golf club head (100) with a small striking face (200).

The foregoing embodiments may be utilized having even larger FB dimensions. For example, the previously described aerodynamic attributes may be incorporated into an embodiment having a front-to-back dimension (FB) that is at least 4.6 inches, or even further a front-to-back dimension (FB) that is at least 4.75 inches. These embodiments allow the high volume aerodynamic golf club head (100) to obtain even higher MOIy values without reducing club head speed due to excessive aerodynamic drag forces.

Yet a further embodiment balances all of the radii of curvature requirements to obtain a high volume aerodynamic golf club head (100) while minimizing the risk of an unnatural appearing golf club head by ensuring that less than 10% of the club head volume is above the elevation of the maximum top edge height (TEH). A further embodiment accomplishes the goals herein with a golf club head (100) having between 5% to 10% of the club head volume located above the elevation of the maximum top edge height (TEH). This range achieves the desired crown apex (410) and radii of curvature to ensure desirable aerodynamic drag while maintaining an aesthetically pleasing look of the golf club head (100).

The location of the crown apex (410) is dictated to a degree by the apex-to-front radius of curvature (Ra-f); however, yet a further embodiment identifies that the crown apex (410) should be behind the forwardmost point on the face (200) a distance that is a crown apex setback dimension (412), seen in FIG. 9, which is greater than 10% of the FB dimension and less than 70% of the FB dimension, thereby further reducing the period of airflow separation and resulting in desirable airflow over the crown section (400). One particular embodiment within this range incorporates a crown apex setback dimension (412) that is less than 1.75 inches. An even further embodiment balances playability with the volume shift toward the face (200) inherent in the present club head (100) by positioning the performance mass to produce a center of gravity (CG) further away from the forwardmost point on the face (200) than the crown apex setback dimension (412).

Additionally, the heel-to-toe location of the crown apex (410) also plays a significant role in the aerodynamic drag force. The location of the crown apex (410) in the heel-to-toe direction is identified by the crown apex ht dimension (414), as seen in FIG. 8. This figure also introduces a heel-to-toe (HT) dimension which is measured in accordance with USGA rules. The location of the crown apex (410) is dictated to a degree by the heel-to-toe radius of curvature (Rh-t); however, yet a further embodiment identifies that the crown apex (410) location should result in a crown apex ht dimension (414) that is greater than 30% of the HT dimension and less than 70% of the HT dimension, thereby aiding in reducing the period of airflow separation. In an even further embodiment, the crown apex (410) is located in the heel-to-toe direction between the center of gravity (CG) and the toe (118).

The present high volume aerodynamic golf club head (100) has a club head volume of at least 400 cc. Further embodiments incorporate the various features of the above described embodiments and increase the club head volume to at least 440 cc, or even further to the current USGA limit of 460 cc. However, one skilled in the art will appreciate that the specified radii and aerodynamic drag requirements are not limited to these club head sizes and apply to even larger club head volumes. Likewise, a heel-to-toe (HT) dimension of the present club head (100), as seen in FIG. 8, is greater than the FB dimension, as measured in accordance with USGA rules.

All of the previously described aerodynamic characteristics with respect to the crown section (400) apply equally to the sole section (300) of the high volume aerodynamic golf club head (100). In other words, one skilled in the art will appreciate that just like the crown section (400) has a crown apex (410), the sole section (300) may have a sole apex. Likewise, the three radii of the crown section (400) may just as easily be three radii of the sole section (300). Thus, all of the embodiments described herein with respect to the crown section (400) are incorporated by reference with respect to the sole section (300).

The various parts of the golf club head (100) may be made from any suitable or desired materials without departing from the claimed club head (100), including conventional metallic and nonmetallic materials known and used in the art, such as steel (including stainless steel), titanium alloys, magnesium alloys, aluminum alloys, carbon fiber composite materials, glass fiber composite materials, carbon pre-preg materials, polymeric materials, and the like. The various sections of the club head (100) may be produced in any suitable or desired manner without departing from the claimed club head (100), including in conventional manners known and used in the art, such as by casting, forging, molding (e.g., injection or blow molding), etc. The various sections may be held together as a unitary structure in any suitable or desired manner, including in conventional manners known and used in the art, such as using mechanical connectors, adhesives, cements, welding, brazing, soldering, bonding, and other known material joining techniques. Additionally, the various sections of the golf club head (100) may be constructed from one or more individual pieces, optionally pieces made from different materials having different densities, without departing from the claimed club head (100).

Numerous alterations, modifications, and variations of the preferred embodiments disclosed herein will be apparent to those skilled in the art and they are all anticipated and contemplated to be within the spirit and scope of the instant club head. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present club head are described herein, it is to be understood that the practice of such additional modifications and variations and the equivalents thereof, are within the spirit and scope of the club head as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A high volume aerodynamic golf club head (100) comprising:

A) a hollow body (110) having a club head volume of at least 400 cc, a face (200), a sole section (300), a crown section (400), a front (112), a back (114), a heel (116), and a toe (118), wherein the hollow body (110) has a front-to-back dimension (FB) of at least 4.4 inches and a heel-to-toe dimension (HT) that is greater than the front-to-back dimension (FB);

B) the crown section (400) having a crown apex (410) located an apex height (AH) above a ground plane (GP), wherein the crown section (400) has a portion of the crown section (400) between the crown apex (410) and the face (200) having an apex-to-front radius of curvature (Ra-f) that is less than 3 inches;

C) the face (200) having a top edge (210) and a lower edge (220), wherein a top edge height (TEH) is the elevation of the top edge (210) above the ground plane (GP), and a lower edge height (LEH) is the elevation of the lower edge (220) above the ground plane (GP), wherein a maximum top edge height (TEH) is at least 2 inches, and an apex ratio of the apex height (AH) to the maximum top edge height (TEH) is at least 1.13; and D) wherein the high volume aerodynamic golf club head (100) has a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100).

2. The high volume aerodynamic golf club head (100) of claim 1, wherein a portion of the crown section (400) between the crown apex (410) and the back (114) of the hollow body (110) has an apex-to-rear radius of curvature (Ra-r), and the apex-to-front radius of curvature (Ra-f) is at least 25% less than the apex-to-rear radius of curvature (Ra-r).

3. The high volume aerodynamic golf club head (100) of claim 1, wherein the apex ratio of the apex height (AH) to the maximum top edge height (TEH) is at least 1.2.

4. The high volume aerodynamic golf club head (100) of claim 1, wherein the apex ratio of the apex height (AH) to the maximum top edge height (TEH) is at least 1.25.

5. The high volume aerodynamic golf club head (100) of claim 1, wherein a portion of the crown section (400) between the crown apex (410) and the back (114) of the hollow body (110) has an apex-to-rear radius of curvature (Ra-r), a portion of the crown section (400) has a heel-to-toe radius of curvature (Rh-t) at the crown apex (410), and the apex-to-front radius of curvature (Ra-f) is less than the apex-to-rear radius of curvature (Ra-r), and the apex-to-rear radius of curvature (Ra-r) is less than the heel-to-toe radius of curvature (Rh-t).

6. The high volume aerodynamic golf club head (100) of claim 1, wherein the apex-to-front radius of curvature (Ra-f) is less than 2.85 inches.

7. The high volume aerodynamic golf club head (100) of claim 1, wherein the front-to-back dimension (FB) is at least 4.6 inches.

8. The high volume aerodynamic golf club head (100) of claim 1, wherein less than 10% of the club head volume is above the elevation of the maximum top edge height (TEH).

9. The high volume aerodynamic golf club head (100) of claim 1, wherein the crown apex (410) is behind the forwardmost point on the face (200) a distance that is a crown apex setback dimension (412), and the crown apex setback dimension (412) is less than 1.75 inches.

10. The high volume aerodynamic golf club head (100) of claim 1, wherein a vertical projection of the center of gravity (CG) on the ground plane (GP) is further from a second vertical projection of the forwardmost point on the face (200) on the ground plane (GP), than the crown apex setback dimension (412).

11. The high volume aerodynamic golf club head (100) of claim 1, wherein at least fifty percent of a plurality of vertical golf club head cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches.

12. The high volume aerodynamic golf club head (100) of claim 1, wherein at least seventy-five percent of a plurality of vertical golf club head cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches.

13. The high volume aerodynamic golf club head (100) of claim 1, wherein a frontal cross sectional area is less than 11 square inches.

14. A high volume aerodynamic golf club head (100) comprising:

A) a hollow body (110) having a club head volume of at least 400 cc, a face (200), a sole section (300), a crown section (400), a front (112), a back (114), a heel (116), and a toe (118), wherein the hollow body (110) has a front-to-back dimension (FB) of at least 4.4 inches;

B) the crown section (400) having a crown apex (410) located an apex height (AH) above a ground plane (GP), wherein the crown section (400) has a portion of the crown section (400) between the crown apex (410) and the face (200) having an apex-to-front radius of curvature (Ra-f) that is less than 3 inches, and wherein at least fifty percent of a plurality of vertical golf club head cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches;

C) the face (200) having a top edge (210) and a lower edge (220), wherein a top edge height (TEH) is the elevation of the top edge (210) above the ground plane (GP), and a lower edge height (LEH) is the elevation of the lower edge (220) above the ground plane (GP), wherein a maximum top edge height (TEH) is at least 2 inches, and an apex ratio of the apex height (AH) to the maximum top edge height (TEH) is at least 1.13; and D) wherein the high volume aerodynamic golf club head (100) has;

i) a first moment of inertia (MOIy) about a vertical axis through a center of gravity (CG) of the high volume aerodynamic golf club head (100) that is at least 4000 $g*cm^2$;

ii) a second moment of inertia (MOIx) about a horizontal axis through the center of gravity (CG) that is at least 2000 $g*cm^2$; and iii) a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100).

15. The high volume aerodynamic golf club head (100) of claim 14, wherein a portion of the crown section (400) between the crown apex (410) and the back (114) of the hollow body (110) has an apex-to-rear radius of curvature (Ra-r), and the apex-to-front radius of curvature (Ra-f) is at least 25% less than the apex-to-rear radius of curvature (Ra-r).

16. The high volume aerodynamic golf club head (100) of claim 14, wherein the apex ratio of the apex height (AH) to the maximum top edge height (TEH) is at least 1.25.

17. The high volume aerodynamic golf club head (100) of claim 14, wherein a portion of the crown section (400) between the crown apex (410) and the back (114) of the hollow body (110) has an apex-to-rear radius of curvature (Ra-r), a portion of the crown section (400) has a heel-to-toe radius of curvature (Rh-t) at the crown apex (410), and the apex-to-front radius of curvature (Ra-f) is less than the apex-to-rear radius of curvature (Ra-r), and the apex-to-rear radius of curvature (Ra-r) is less than the heel-to-toe radius of curvature (Rh-t).

18. The high volume aerodynamic golf club head (100) of claim 14, wherein the apex-to-front radius of curvature (Ra-f) is less than 2.85 inches.

19. The high volume aerodynamic golf club head (100) of claim 14, wherein a frontal cross sectional area is less than 11 square inches.

20. A high volume aerodynamic golf club head (100) comprising:

A) a hollow body (110) having a club head volume of at least 400 cc, a face (200), a sole section (300), a crown section (400), a front (112), a back (114), a heel (116), and a toe (118), wherein the hollow body (110) has a front-to-back dimension (FB) of at least 4.4 inches;

B) the crown section (400) having a crown apex (410) located an apex height (AH) above a ground plane (GP), wherein the crown section (400) has a portion of the crown section (400) between the crown apex (410) and the face (200) having an apex-to-front radius of curvature (Ra-f) that is less than 3 inches, and wherein at least seventy five percent of a plurality of vertical golf club head cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches;

C) the face (200) having a top edge (210) and a lower edge (220), wherein a top edge height (TEH) is the elevation of the top edge (210) above the ground plane (GP), and a lower edge height (LEH) is the elevation of the lower edge (220) above the ground plane (GP), wherein a maximum top edge height (TEH) is at least 2 inches, and an apex ratio of the apex height (AH) to the maximum top edge height (TEH) is at least 1.13; and D) wherein the high volume aerodynamic golf club head (100) has;

i) a first moment of inertia (MOIy) about a vertical axis through a center of gravity (CG) of the high volume aerodynamic golf club head (100) that is at least 4000 $g*cm^2$;

ii) a second moment of inertia (MOIx) about a horizontal axis through the center of gravity (CG) that is at least 2000 $g*cm^2$;

iii) a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100); and iv) a frontal cross sectional area is less than 11 square inches.

* * * * *